US006806449B2

(12) United States Patent
Lee et al.

(10) Patent No.: US 6,806,449 B2
(45) Date of Patent: Oct. 19, 2004

(54) APPARATUS AND METHOD OF CONTROLLING A MICROWAVE OVEN

(75) Inventors: Sung-Ho Lee, Kyungki-Do (KR); Young-Won Cho, Kyungki-Do (KR); Han-Seong Kang, Kyungki-Do (KR); Kyung-Hoo Hahm, Seoul (KR); Too-Soo Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 117 days.

(21) Appl. No.: 10/188,061

(22) Filed: Jul. 3, 2002

(65) Prior Publication Data

US 2003/0189040 A1 Oct. 9, 2003

(30) Foreign Application Priority Data

Apr. 4, 2002 (KR) ..... 2002-18377

(51) Int. Cl.[7] ..... H05B 6/68

(52) U.S. Cl. ..... 219/707; 219/716; 219/719

(58) Field of Search ..... 219/707, 716, 219/703, 704, 705, 710, 715, 719, 754, 728, 682, 685, 482; 99/325

(56) References Cited

U.S. PATENT DOCUMENTS

| | | | | | |
|---|---|---|---|---|---|
| 4,864,088 | A | * | 9/1989 | Hiejima et al. | 219/707 |
| 5,530,229 | A | | 6/1996 | Gong et al. | |
| 5,889,264 | A | * | 3/1999 | Kidblad et al. | 219/707 |
| 6,538,240 | B1 | * | 3/2003 | Shon et al. | 219/707 |
| 6,642,491 | B1 | * | 11/2003 | Torngren et al. | 219/705 |

* cited by examiner

*Primary Examiner*—Quang T. Van
(74) *Attorney, Agent, or Firm*—Staas & Halsey LLP

(57) ABSTRACT

An apparatus and a method of controlling a microwave oven includes performing a first heating until detection values of a humidity sensor reach a reference value, wherein the humidity sensor senses humidity of water vapor discharged from a cooking chamber. A second heating is performed, lower than the first heating, after the detection values reach the reference value using an output power from a magnetron. A surrounding humidity condition of the microwave oven is determined. The reference value of the first heating is reset so as to cook food appropriately according to the determined humidity condition.

10 Claims, 7 Drawing Sheets

APPARATUS AND METHOD OF CONTROLLING A MICROWAVE OVEN

CROSS-REFERENCE TO RELATED APPLICATIONS

This application claims the benefit of Korean Application No. 2002-18377, filed Apr. 4, 2002, in the Korean Patent Office, the disclosure of which is incorporated herein by reference.

BACKGROUND OF THE INVENTION

1. Field of the Invention

The present invention relates generally to microwave ovens, and more particularly to an apparatus and a method of controlling a microwave oven, which can cook foods under optimal cooking conditions regardless of surrounding humidity conditions by compensating for variation of cooking conditions due to the surrounding humidity conditions.

2. Description of the Related Art

Generally, when rice is cooked in a conventional microwave oven, a first heating is performed until rice water reaches a boiling point of 100° C., and then a second heating is performed for a predetermined period of time after the rice water reaches the boiling point using an output power of a magnetron lower than that of the first heating.

The microwave oven is not equipped with a temperature sensor and thus, detects the boiling of the rice water using a detection value from a humidity sensor, which senses a humidity value of water vapor discharged from a cooking chamber so as to detect the boiling point of the rice water.

FIG. 1A is a waveform diagram showing a relationship between sensing voltages of a humidity sensor and time in the conventional microwave oven. FIG. 1B is a waveform diagram showing a relationship between output powers of a magnetron and time in the conventional microwave oven. FIG. 1C is a waveform diagram showing a relationship between boiling temperatures of water and time in the conventional microwave oven. As shown in FIG. 1A, at a beginning of heating food, the output power of the magnetron is maximized to rapidly heat the food, and then, the output power is gradually lowered while continuing to heat the food. If the rice water boils, rice continues to be heated using low output power suitable for steaming boiled rice, so the rice is cooked. Accordingly, the humidity value sensed by the humidity sensor is a constant value at the start of cooking, rapidly increasing when rice water reaches the boiling point, and gradually decreasing thereafter.

A sensing voltage graph of the humidity sensor, as shown in FIG. 1A, shows a variation of the humidity value. A reference value (T1 FACTOR) of the humidity sensor, corresponding to the boiling point (100° C.) of the rice water, is estimated on a basis of sensing voltage values. Generally, the reference value is uniformly set at a value of, for example, 85% of a maximum voltage MAX of the sensing voltages on a basis of a normal surrounding humidity condition.

However, a sensor for sensing relative humidity, not absolute humidity, is mainly used as the humidity sensor due to problems such as cost, etc. Then, if the surrounding humidity condition of the microwave oven is lower than that of a normal state, that is, a dry state, such as during Winter, the maximum voltage MAX sensed by the humidity sensor is relatively increased. Therefore, the voltage at 85% of the maximum voltage does not reflect the boiling point of rice water. Consequently, the output power of the magnetron is decreased to output a low output power suitable for steaming the rice before the rice water boils, thus causing rice to be half-cooked.

SUMMARY OF THE INVENTION

Various objects and advantages of the invention will be set forth in part in the description that follows and, in part, will be obvious from the description, or may be learned by practice of the invention.

Accordingly, the present invention has been made keeping in mind the above problems occurring in the related art, and an object of the present invention is to provide a method of controlling a microwave oven to cook foods under optimal cooking conditions regardless of a surrounding humidity condition, by compensating for a variation of cooking conditions due to the surrounding humidity condition.

To achieve the above and other objects, the present invention provides a method of controlling a microwave oven, including: performing a first heating until detection values of a humidity sensor reach a reference value, wherein the humidity sensor senses humidity of water vapor discharged from a cooking chamber; performing a second heating, lower than the first heating, after the detection values reach the reference value using an output power from a magnetron; determining a surrounding humidity condition of the microwave oven; and resetting the reference value of the first heating so as to cook food appropriately Further, to achieve the above and other objects, the present invention provides a method of controlling a microwave oven, including: performing a first heating until detection values of a humidity sensor reach a reference value, wherein the humidity sensor senses humidity of water vapor discharged from a cooking chamber; performing a second heating, lower than that of the first heating, for a set period of time after the detection values reach the reference value using an output power from a magnetron; determining a surrounding humidity condition of the microwave oven; and resetting a period of time for the second heating so as to cook food appropriately according to the determined humidity condition.

To achieve the above and other objects, the present invention provides a control method of a microwave oven, including: maximizing an output power; counting a first heating time; reading sensing voltages from a humidity sensor during the first heating time; comparing the sensing voltages sensed by the humidity sensor with each other to determine a maximum voltage; setting a first reference value at a predetermined voltage level from the maximum voltage; determining whether a current sensing voltage sensed by the humidity sensor has reached the first reference value; decreasing the output power to a low power; determining whether the current mode is in a dry mode or a normal mode; setting a preset time as a reference period of time for a second heating time corresponding to the counted heating time; outputting the low power for a predetermined period of time of the second heating time; increasing the output power of the microwave oven to perform a cooking operation after the predetermined period of time of the second heating time elapses; and stopping the cooking operation of the microwave oven after the second heating time has elapsed.

To achieve the above and other objects, the present invention provides an apparatus to control a microwave oven, including: a control unit counting a time from a start of heating to a time point when a first reference value is detected, comparing the counted heating time with a predicted heating time preset; and determining a current mode as a dry mode when the counted heating time is shorter than the predicted heating time.

To achieve the above and other objects, the present invention provides an apparatus to control a microwave oven, including: a control unit determining a surrounding humidity condition of the microwave oven, and compensating for a variation of heating time due to the surrounding humidity of the microwave oven according to seasons or areas in which the microwave oven is used to provide an optimal heating time enabling the microwave oven to optimally cook food, regardless of surrounding conditions.

To achieve the above and other objects, the present invention provides a method of controlling a microwave oven, including: counting a time from a start of heating to a time point when a first reference value is detected; comparing the counted heating time with a predicted heating time preset; and determining a current mode as a dry mode when the counted heating time is shorter than the predicted heating time.

To achieve the above and other objects, the present invention provides a method of controlling a microwave oven, including: determining a surrounding humidity condition of the microwave oven; and compensating for a variation of heating time due to the surrounding humidity of the microwave oven according to seasons or areas in which the microwave oven is used to provide an optimal heating time enabling the microwave oven to optimally cook food, regardless of surrounding conditions.

These together with other objects and advantages, which will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Hereinafter, embodiments of the present invention will be described in detail with reference to the attached drawings. The present invention may, however, be embodied in many different forms and should not be construed as being limited to the embodiments set forth herein; rather, these embodiments are provided so that the present disclosure will be thorough and complete, and will fully convey the concept of the invention to those skilled in the art.

Figure 1A:
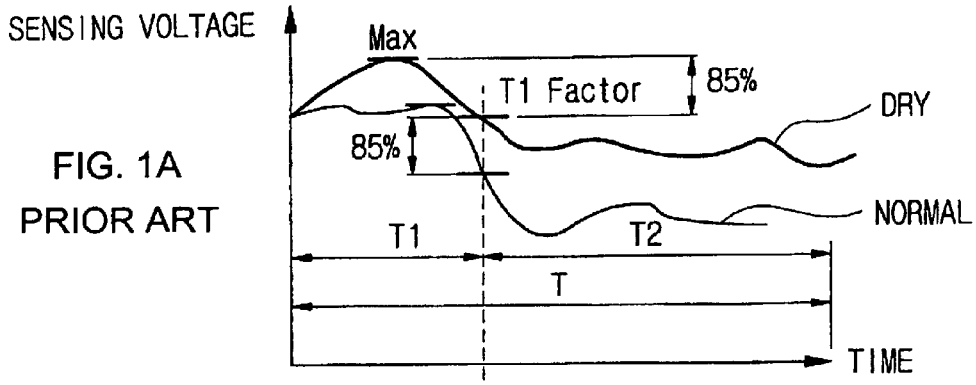
FIG. 1A PRIOR ART
FIG. 1A is a waveform diagram showing a relationship between sensing voltages of a humidity sensor and time in the conventional microwave oven when a surrounding humidity of the microwave oven is in normal and dry states.
Figure 1B:
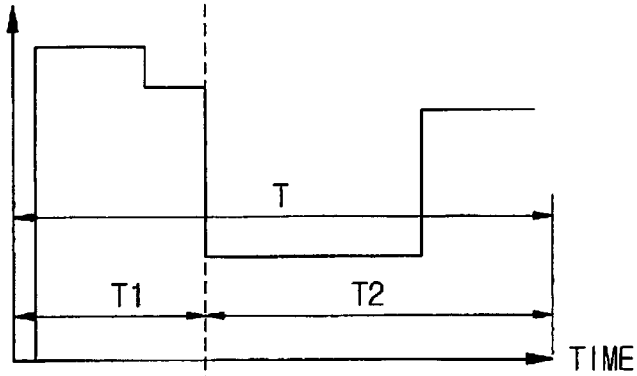
FIG. 1B PRIOR ART
FIG. 1B is a waveform diagram showing a relationship between output powers of a magnetron and time in the conventional microwave oven when the surrounding humidity of the microwave oven is in the normal and dry states.
Figure 1C:
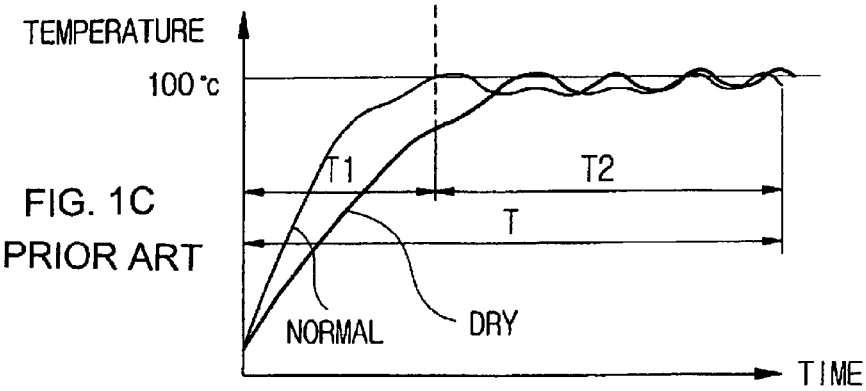
FIG. 1C PRIOR ART
FIG. 1C is a waveform diagram showing a relationship between boiling temperatures of water and time in the conventional microwave oven when the surrounding humidity of the microwave oven is in the normal and dry states.
Figure 2:
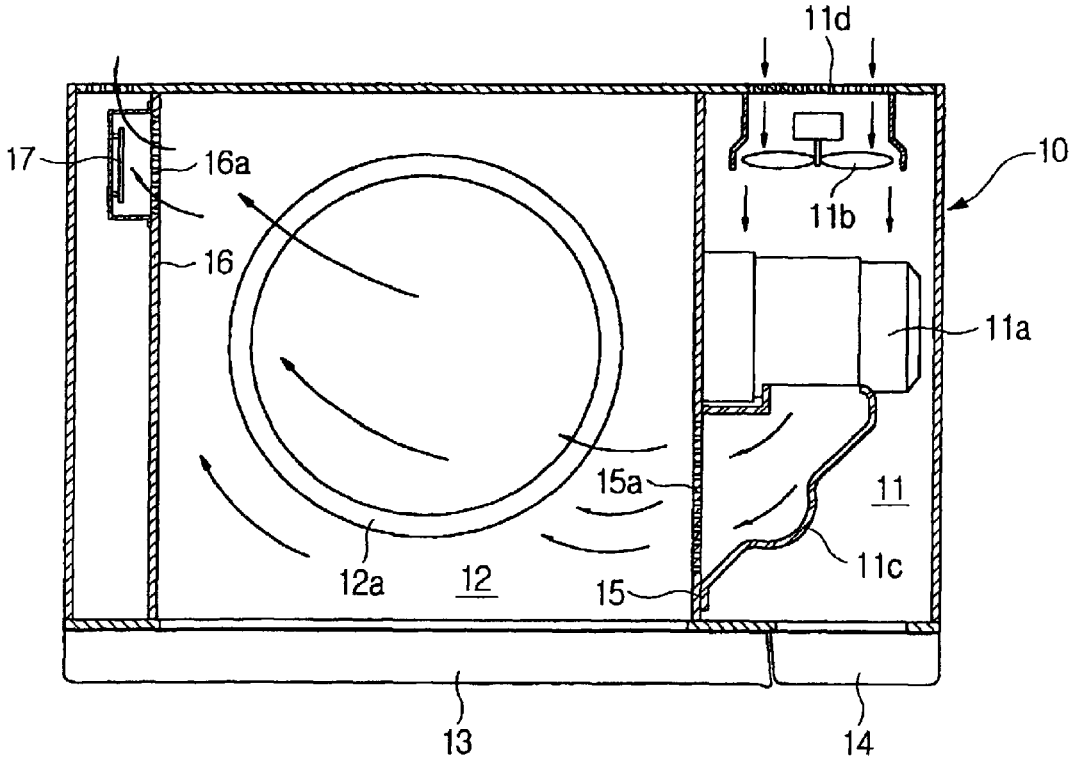
FIG. 2 is a top sectional view showing a construction of a microwave oven according to an embodiment of the present invention.

FIG. 2 is a top sectional view showing the construction of a microwave oven according to an embodiment of the present invention. Referring to FIG. 2, the microwave oven of the present invention includes a body 10, which constitutes an external shape of the microwave oven and defines a cooking chamber 12 and a machine room 11 separately partitioned. A door 13 is connected to the body 10 by a hinge to open and shut the cooking chamber 12, a control panel 14 is installed on a front of the body 10 and provided with a plurality of functional buttons thereon, and a humidity sensor 17 senses a humidity of the cooking chamber 12.

The cooking chamber 12 opens at the front of the body 10, where a cooking tray 12*a* in a form of a turntable is installed on a bottom portion of the cooking chamber 12 and a motor is installed under the cooking tray 12*a* to rotate the cooking tray 12*a*. Further, an inlet 15*a*, communicating with the machine room 11 to suck the external air into the cooking chamber 12, is formed on a front portion of one sidewall 15 of the cooking chamber 12. Further, an outlet 16*a* is formed on a back portion of another sidewall 16 of the cooking chamber 12 to discharge the air in the cooking chamber 12 to the outside.

Further, in the machine room 11, a magnetron 1*a* is installed to oscillate microwaves, a cooling fan 11*b* is installed to suck the external air to cool the machine room 11 and the cooking chamber 12, and a guide duct 11*c* is installed to guide the air in the machine room 11 to the inlet 15*a*. The cooling fan 11*b* is disposed between a magnetron 11*a* and a back wall of the machine room 11. A plurality of suction holes 11*d* are formed on the back wall of the machine room 11 to suck the external air into the machine room 11.

The humidity sensor 17 is mounted on the sidewall 16 of the cooking chamber 12 adjacent to the outlet 16*a* to be disposed along the air discharging path of the cooking chamber 12. Therefore, the humidity sensor 17 senses the humidity of the air being discharged from the cooking chamber 12 through the outlet 16*a*. The humidity sensor 17 is electrically connected to a control unit formed on the control panel 14, as will be described later.

Figure 3:
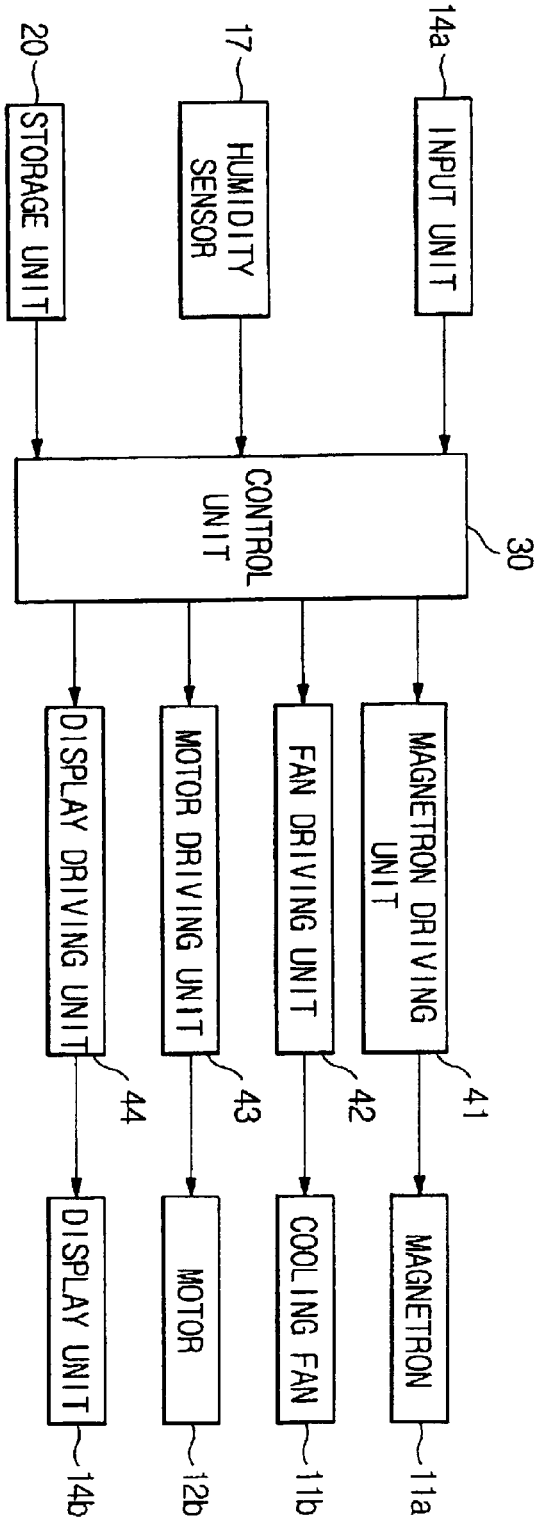
FIG. 3 is a block diagram of the microwave oven of FIG. 2.

FIG. 3 is a block diagram of the microwave oven according to an embodiment of the present invention. Referring to FIG. 3, the microwave oven includes a control unit 30 to control operations of the microwave oven. The control unit 30 is connected to an input unit 14*a* arranged in the control panel 14 to allow a user to input operation commands, such as rice cooking for one person and two persons. Further, the control unit 30 is connected to the humidity sensor 17 to sense humidity.

Further, the microwave oven has a storage unit 20 electrically connected to the control unit 30, to store various data for cooking. Furthermore, the control unit 30 is electrically connected to a magnetron driving unit 41 to drive the magnetron 11*a,* a fan driving unit 42 to drive the cooling fan 11*b,* a motor driving unit 43 to drive a motor 12*b* for rotating the cooking tray 12*a,* and a display driving unit 44 to drive a display unit 14*b* arranged on the control panel 14 to display information. When the user manipulates the input unit 14*a* of the control panel 14 to operate the microwave oven, the microwave oven according to an embodiment of the present invention cooks food placed on the cooking tray 12*a* by radiating microwaves that are oscillated by the magnetron 11*a* to the cooking chamber 12.

Further, the external air is sucked into the machine room 11 through the suction holes 11*d* to cool the machine room 11 by the action of the cooling fan 11*b* during a cooking operation of the microwave oven, and is provided to the cooking chamber 12 through the guide duct 11*c* and the inlet 15*a.* Then, the air in the cooking chamber 12 is discharged to the outside through the outlet 16*a,* together with water vapor generated from the food, as shown by an arrow in FIG. 3. Accordingly, odor and water vapor can be eliminated from the cooking chamber 12. In this case, the air in the cooking chamber 12 is discharged to the outside while being brought into contact with the humidity sensor 17, so the humidity sensor 17 senses water vapor contained in the discharged air and transmits the sensed water vapor to the control unit 30 as electrical signals. The control unit 30 recognizes such electrical signals as voltage values. The control unit 30 drives the magnetron 11*a,* the motor 12*b* and the cooling fan 11*b* to automatically cook the food based on the electrical signals received from the humidity sensor 17.

Figure 4:
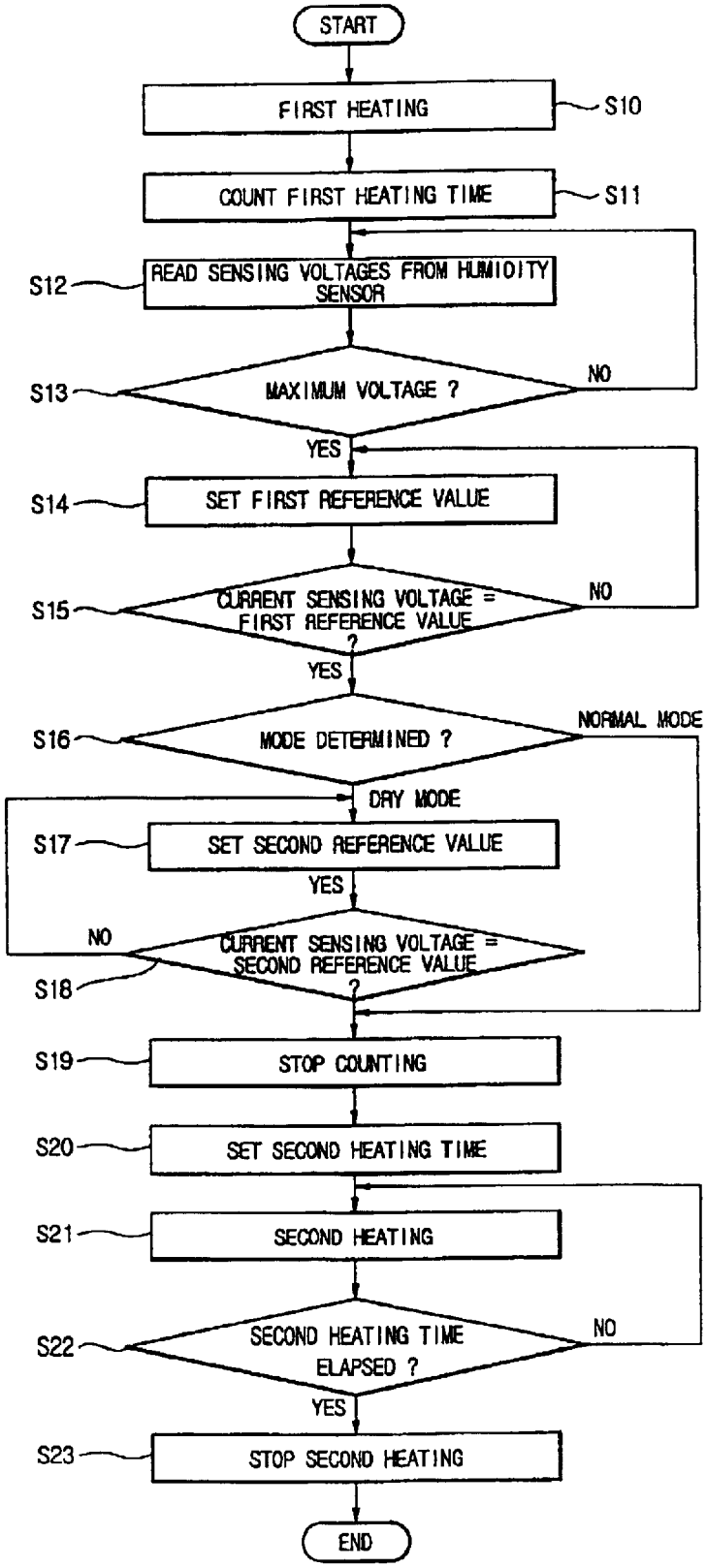
FIG. 4 is a flowchart of a method of controlling the microwave oven according to an embodiment of the present invention.

Hereinafter, a method of controlling a microwave oven to cook rice according to an embodiment of the present invention will be described in detail. FIG. 4 is a flowchart of a method of controlling the microwave oven according to an embodiment of the present invention. Referring to FIG. 4, the user places a bowl, in which rice and a suitable quantity of water are mixed, in the cooking chamber 12 so as to cook the rice. The user then selects a cooking course for one person or two persons through the input unit 14*a.* At S10, the control unit 30 heats the food by driving the magnetron 11*a* to maximize its output power. At S11, the control unit 30 counts a first heating time.

At S12, the control unit 30 reads sensing voltages from the humidity sensor 17 for a predetermined period of time of the first heating time. At S13, the control unit 30 compares the sensing voltages sensed by the humidity sensor 17 with each other and determines a maximum voltage.

If the maximum voltage is determined, at S14, the control unit 30 sets a voltage at 85% of the maximum voltage as a first reference value. At S15, the control unit 30 determines whether a current sensing voltage determined from the humidity sensed by the humidity sensor 17 has reached the first reference value. In this case, the first reference value is a humidity value when the temperature of water reaches the boiling point (100° C.), the humidity value being obtained through experiments to determine the humidity and the temperature of water when a surrounding humidity condition of the microwave oven is normal.

At S15, if the current sensing voltage has reached the first reference value, at S16, the control unit 30 determines whether a current mode is in a dry mode or a normal mode by a mode determining method to be described later.

If it is determined that the current mode is in the normal mode, at S19, the control unit 30 decreases the output power of the magnetron 11*a* to a low power suitable for steaming boiled rice, and stops the counting of the heating time. Then, at S20, the control unit 30 sets a preset time as a reference period of time for a second heating (second heating time) corresponding to the counted heating time.

If the second heating time is set, during the second heating time, at S21, the control unit 30 operates the magnetron 11*a* to output the low power required to steam boiled rice for a predetermined period of time of the second heating time, while the control unit 30 increases the output power of the magnetron 11*a* to perform a cooking operation after the predetermined period of time of the second heating time elapses. At S22, after the second heating time has elapsed, the control unit 30 stops the driving of the magnetron 11*a.* At S23, the control unit 30 finishes the cooking.

Figure 5A:
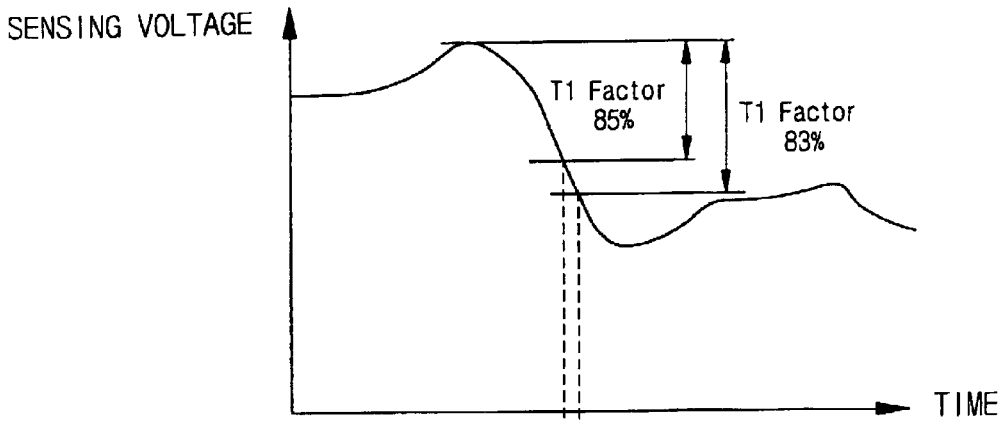
FIGS. 5A and 5B are graphs showing first and second reference values of FIG. 4.
Figure 5B:
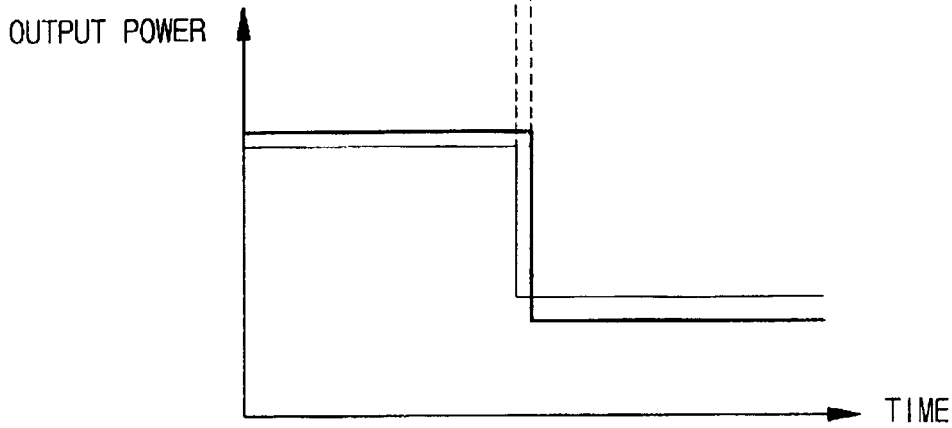

Further, at S16, if the current mode is in the dry mode, at S17, the control unit 30 sets a second reference value (a voltage at 83% of the maximum voltage) lower than the first reference value, instead of the first reference value, so as to heat the food a little longer, as shown in FIGS. 5A and 5B. Accordingly, as shown in FIGS. 5A and 5B, a reference value is decreased to a voltage at 83%, lower that the previous 85%, of the maximum voltage, such that a time taken for the sensing voltage to reach the reference value is lengthened, thus allowing the food to be heated a little longer.

At S17, if the second reference value is set, at S18, the control unit 30 determines whether the current sensing voltage has reached the second reference value. At S18, if the current sensing voltage has reached the second reference value, at S19, the control unit 30 decreases the output power of the magnetron 11*a* to the low power suitable to steam boiled rice, and stops the counting of the heating time. At S20, the control unit 30 sets a preset time corresponding to the counted heating time as the second heating time.

During the second heating time, at S21, the control unit 30 operates the magnetron 11*a* to output the low power required to steam boiled rice for a predetermined period of time of the second heating time, while the control unit 30 increases the output power of the magnetron 11*a* to perform the cooking operation after the predetermined period of time of the second heating time elapses. At S22, after the second heating time has elapsed, at S23, the control unit 30 stops the driving of the magnetron 11*a* and finishes the cooking.

Figure 6:
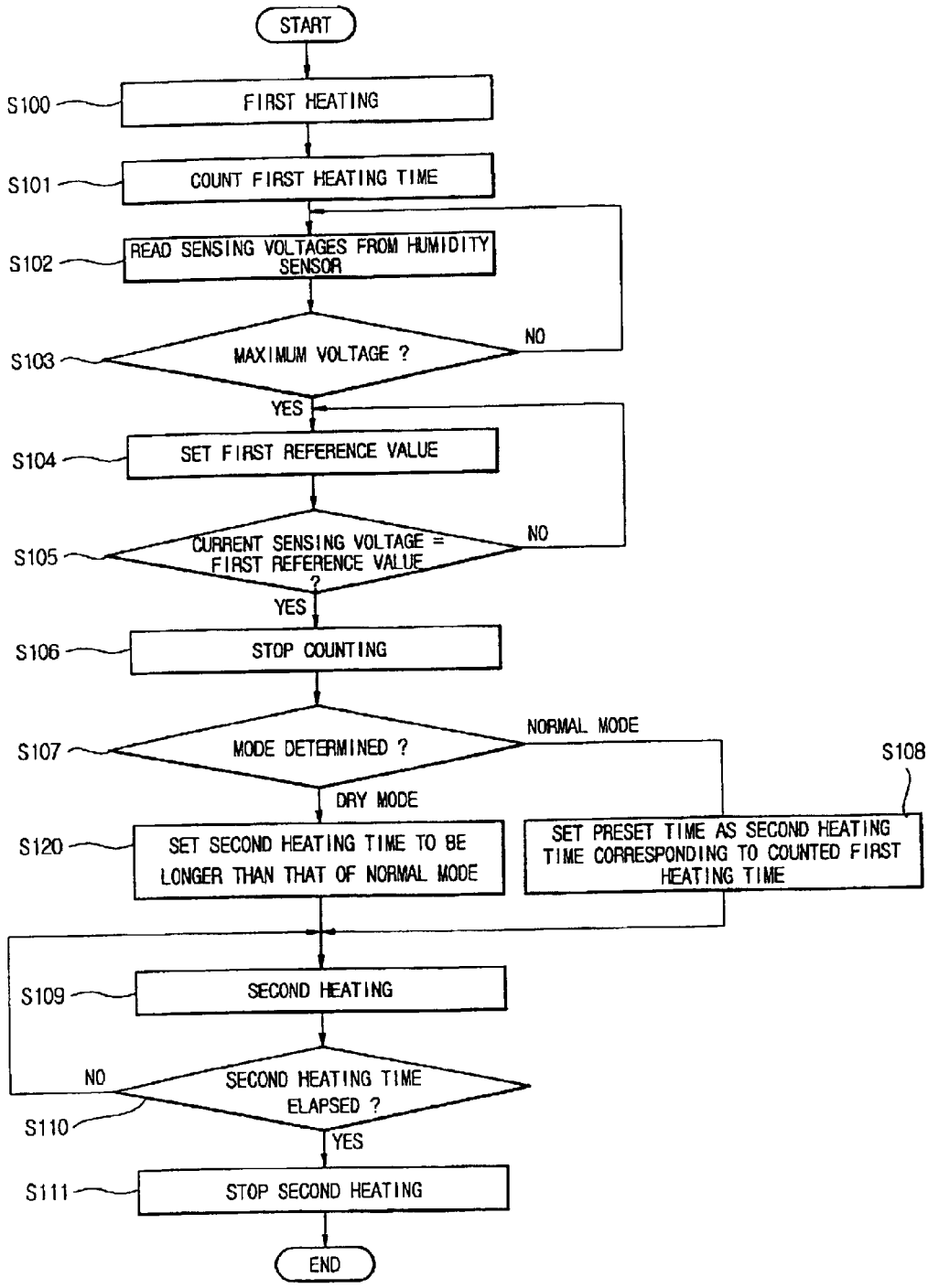
FIG. 6 is a flowchart of another microwave oven control method to change a second heating time in a dry mode, according to another embodiment of the present invention.

FIG. 6 is a flowchart of another microwave oven control method of changing the second heating time in a dry mode instead of the reference value during the first heating, according to another embodiment of the present invention.

Referring to FIG. 6, at S100, the control unit 30 heats the food by driving the magnetron 11*a* to maximize the output power, and, at S101, counts the first heating time. At S102, the control unit 30 reads the sensing voltages from the humidity sensor 17 for a predetermined period of time of the first heating time. Further at S103, the control unit 30 compares the sensing voltages sensed by the humidity sensor 17 with each other, and sets the maximum voltage.

If the maximum voltage is set, at S104, the control unit 30 sets a voltage at 85% of the maximum voltage as a first reference value. At S105, the control unit 30 determines whether the current sensing voltage determined from the humidity sensed by the humidity sensor 17 has reached the first reference value.

At S105, if the current sensing voltage has reached the first reference value, at S106, the control unit 30 decreases the output power of the magnetron 11*a* to a low power suitable for steaming boiled rice, and stops the counting of the heating time. Then, at S107, the control unit 30 determines whether the current mode is in the dry mode or the normal mode by a mode determining method to be described later If the current mode is in the normal mode, at S108, the control unit 30 sets a preset time as the second heating time corresponding to the counted heating time.

If the second heating time is set, at S109, during the second heating time, the control unit 30 operates the magnetron 11*a* to output low power required to steam boiled rice for a predetermined period of time of the second heating time, while the control unit 30 increases the output power of the magnetron 11*a* to perform a cooking operation after the predetermined period of time of the second heating time elapses. After the second heating time has elapsed, at S110 and S111, the control unit 30 stops the driving of the magnetron 11*a* and finishes the cooking.

Further at S106, if the current mode is in the dry mode, at S120, the control unit 30 sets the second heating time to be longer than the preset time. If the second heating time is set, at S109, during the second heating time, the control unit 30 operates the magnetron 11*a* to output low power required to steam boiled rice for a predetermined period of time of the second heating time, while the control unit 30 increases the output power of the magnetron 11*a* to perform a cooking operation after the predetermined period of time of the second heating time elapses. After the second heating time has elapsed, at S110 and S111, the control unit 30 stops the driving of the magnetron 11*a* and finishes the cooking.

Hereinafter, the dry mode determining method of FIGS. 4 and 6 is described. There are two methods to determine the dry mode of FIGS. 4 and 6.

Figure 7:
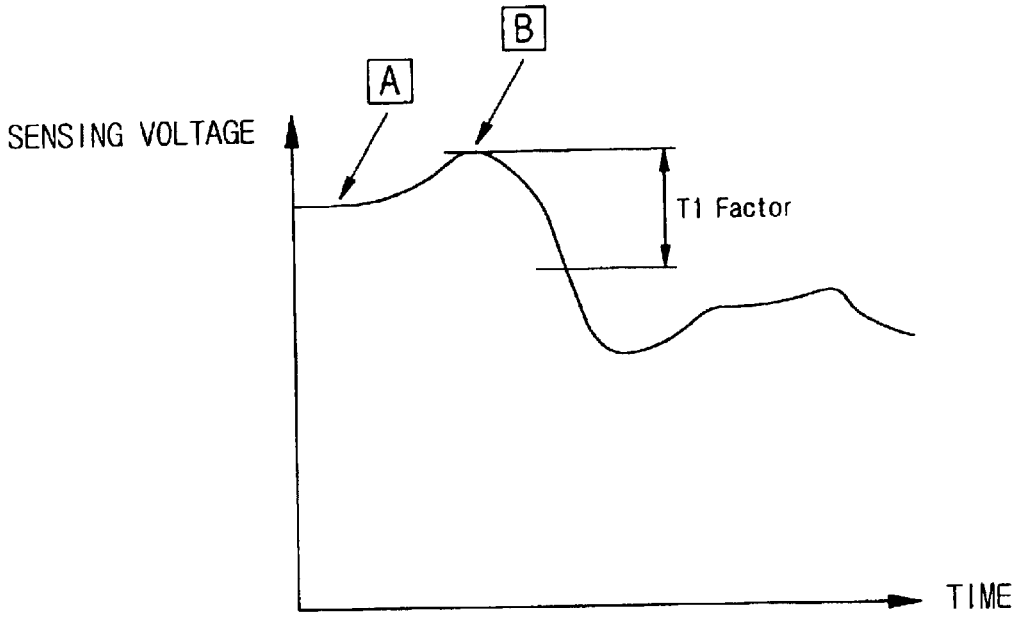
FIG. 7 is a waveform diagram showing sensing voltages of a humidity sensor to describe a method of determining a mode of FIGS. 4 and 6.

A first method is performed by determining the current mode as the dry mode if a voltage waveform between points A and B ascends as shown in FIG. 7, and by determining the current mode as the normal mode if the voltage waveform is constant or descends. That is, sensing voltages sensed by the humidity sensor 17 for a predetermined period of time are compared with each other, such that the current mode is determined as the dry mode if the sensing voltages are gradually increased. Alternatively, the maximum voltage is set by comparing sensing voltages sensed by the humidity sensor 17 for a predetermined period of time with each other, and if a voltage at the start of heating is less than the maximum voltage, the current mode is determined as the dry mode. This determination is due to a phenomenon where if the surrounding humidity of a microwave oven is decreased, the humidity within the cooking chamber is affected to cause the waveform of the sensing voltages of the humidity sensor 17 to ascend.

A second method is performed by counting a time from the start of heating to a time point when the first reference value is detected, comparing the counted heating time with a predicted heating time preset for a case where the surrounding humidity of the microwave oven is normal, and determining the current mode as the dry mode if the counted heating time is shorter than the predicted heating time. The second method considers that, when the surrounding humidity of the microwave oven is in the dry mode, heating time becomes shorter than that of a normal mode.

As described above, the present invention provides a method of controlling a microwave oven, which provides an optimal heating time by compensating for a variation of heating time due to surrounding humidity of the microwave oven according to seasons or areas in which the microwave oven is used, thus enabling the microwave oven to optimally cook food, regardless of surrounding conditions.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of controlling a microwave oven having a cooking chamber, a magnetron, and a humidity sensor adapted to sense a humidity of water vapor discharged from the cooking chamber, comprising:

performing a first heating at a maximum output power level;

reading a detection value outputted from the humidity sensor;

determining, based on the read detection value, whether or not a surrounding humidity condition of the microwave oven corresponds to a dry state;

if it is determined that the surrounding humidity condition of the microwave oven corresponds to the dry state, setting a reference value, at which the first heating is to be stopped, to be lower than a corresponding value predetermined for a normal surrounding humidity condition of the microwave oven;

determining whether or not the read detection value corresponds to the set reference value;

if it is determined that the read detection value corresponds to the set reference value, stopping the first heating, and performing a second heating for a predetermined time at an output power level lower than the output power level at the first heating; and stopping the second heating after the predetermined time has elapsed.

2. The method according to claim 1, wherein the determining of the surrounding humidity condition comprises:

detecting a variation in the detection value outputted from the humidity sensor until the detection value reaches a maximum value during the first heating;

determining whether or not the detection value variation has an increment gradient; and if it is determined that the detection value variation has an increment gradient, determining the surrounding humidity condition of the microwave oven as the dry state.

3. The method according to claim 1, wherein the determining of the surrounding humidity condition comprises:

counting a time taken until the detection value reaches a predetermined reference value during the first heating;

determining whether or not the counted time is shorter than a count time predetermined for the normal surrounding humidity condition of the microwave oven; and if the counted time is shorter than the predetermined count time, determining the surrounding humidity condition of the microwave oven as the dry state.

4. A method of controlling a microwave oven having a cooking chamber, a magnetron, and a humidity sensor adapted to sense a humidity of water vapor discharged from the cooking chamber, comprising:

performing a first heating at a predetermined output power level;

reading a detection value outputted from the humidity sensor;

determining whether or not the read detection value corresponds to a reference value, at which the first heating is to be stopped;

if it is determined that the read detection value corresponds to the reference value, determining whether or not a surrounding humidity condition of the microwave oven corresponds to a dry state;

if it is determined that the surrounding humidity condition of the microwave oven corresponds to the dry state, re-setting the reference value to a value lower than the reference value;

determining whether or not the read detection value corresponds to the re-set reference value;

if it is determined that the read detection value corresponds to the re-set reference value, stopping the first heating, and performing a second heating for a predetermined time at an output power level lower than the output power level at the first heating; and stopping the second heating after the predetermined time has elapsed.

5. The method according to claim 4, wherein detecting a variation in the detection value outputted from the humidity sensor until the detection value reaches a maximum value during the first heating;

determining whether or not the detection value variation has an increment gradient; and if it is determined that the detection value variation has an increment gradient, determining the surrounding humidity condition of the microwave even as the dry state.

6. The method according to claim 4, wherein the determining of the surrounding humidity condition comprises:

counting a time taken until the detection value reaches a predetermined reference value during the first heating;

determining whether or not the counted time is shorter than a count time predetermined for the normal surrounding humidity condition of the microwave oven; and if the counted time is shorter than the predetermined count time, determining the surrounding humidity condition of the microwave oven as the dry state.

7. A control method of a microwave oven, comprising:

maximizing an output power;

counting a first heating time;

reading sensing voltages from a humidity sensor during the first heating time;

comparing the sensing voltages sensed by the humidity sensor with each other to determine a maximum voltage;

setting a first reference value at a predetermined voltage level from the maximum voltage;

determining whether a current sensing voltage sensed by the humidity sensor has reached the first reference value;

decreasing the output power to a low power;

stopping the counting of the first heating time;

setting a preset time as a reference period of time for a second heating time corresponding to the counted heating time;

outputting the low power for a predetermined period of time of the second heating time;

increasing the output power of the microwave oven to perform a cooking operation after the predetermined period of time of the second heating time elapses; and stopping the cooking operation of the microwave oven after the second heating time has elapsed.

8. The control method according to claim 7, further comprising determining whether the current mode is in a dry mode or a normal mode.

9. The control method according to claim 8, wherein when the current mode is in the dry mode, the method further comprises:

setting a second reference value lower than the first reference value heating food in the microwave oven longer; and determining whether the current sensing voltage has reached the second reference value.

10. The control method according to claim 7, wherein the first reference value is a humidity value when a surrounding humidity condition of the microwave oven is normal.

* * * * *

UNITED STATES PATENT AND TRADEMARK OFFICE

CERTIFICATE OF CORRECTION

PATENT NO. : 6,806,449 B2
DATED : October 19, 2004
INVENTOR(S) : Sung-Ho Lee et al.

It is certified that error appears in the above-identified patent and that said Letters Patent is hereby corrected as shown below:

Title page,
Item [75], Inventors, please change "Kyung-Hoo Hahm" to -- Kyung Hee Hahm -- and change "Too-Soo Kim" to -- Tae-Soo Kim --.

Column 9,
Line 27, change "even" to -- oven --.

Signed and Sealed this

Tenth Day of May, 2005

JON W. DUDAS
*Director of the United States Patent and Trademark Office*